US010749276B2

(12) United States Patent
Mohan

(10) Patent No.: US 10,749,276 B2
(45) Date of Patent: Aug. 18, 2020

(54) SPATIAL POWER-COMBINING DEVICES AND ANTENNA ASSEMBLIES

(71) Applicant: Qorvo US, Inc., Greensboro, NC (US)

(72) Inventor: Ankush Mohan, Thousand Oaks, CA (US)

(73) Assignee: Qorvo US, Inc., Greensboro, NC (US)

( * ) Notice: Subject to any disclaimer, the term of this patent is extended or adjusted under 35 U.S.C. 154(b) by 0 days.

(21) Appl. No.: 15/981,516

(22) Filed: May 16, 2018

(65) Prior Publication Data

US 2019/0067836 A1 Feb. 28, 2019

Related U.S. Application Data

(60) Provisional application No. 62/548,472, filed on Aug. 22, 2017.

(51) Int. Cl.
*H01Q 25/00* (2006.01)
*H01Q 5/55* (2015.01)
(Continued)

(52) U.S. Cl.
CPC ..... *H01Q 25/005* (2013.01); *H01P 5/085* (2013.01); *H01Q 5/55* (2015.01); *H01Q 13/085* (2013.01); *H01Q 23/00* (2013.01)

(58) Field of Classification Search
CPC ..... H01Q 5/55; H01Q 23/00; H01Q 25/005; H01Q 13/085; H01P 5/085
(Continued)

(56) References Cited

U.S. PATENT DOCUMENTS 3,023,382 A 2/1962 Borghetti
4,234,854 A 11/1980 Schellenberg et al.
(Continued)

FOREIGN PATENT DOCUMENTS

WO 2017214357 A2 12/2017

OTHER PUBLICATIONS

Author Unknown, "Interpack 2005: An assessment for PMMI members," 2005, PMMI, 32 pages.
(Continued)

*Primary Examiner* — Robert J Pascal
*Assistant Examiner* — Kimberly E Glenn
(74) *Attorney, Agent, or Firm* — Withrow & Terranova, P.L.L.C.

(57) ABSTRACT

Spatial power-combining devices and antenna assemblies for spatial power-combining devices are disclosed. A spatial power-combining device may include an input coaxial waveguide section, an output coaxial waveguide section, and a center waveguide section. The center waveguide section may include an input center waveguide section, an output center waveguide section, and a core section. The core section may form an integral single component with an input inner housing of the input center waveguide section and an output inner housing of the output center waveguide section. Alternatively, the core section may be attached to the input inner housing and the output inner housing. The plurality of amplifiers may be registered with the core section. Antenna assemblies may include antennas with signal and ground conductors that are separated by air. Representative spatial power-combining devices may be designed with high efficiency, high or low frequency ranges, ultra-wide bandwidth operation, and high output power.

25 Claims, 11 Drawing Sheets

(51) Int. Cl.

| | |
|---|---|
| ***H01Q 23/00*** | (2006.01) |
| ***H01P 5/08*** | (2006.01) |
| ***H01Q 13/08*** | (2006.01) |

(58) Field of Classification Search
USPC ..... 333/125
See application file for complete search history.

(56) References Cited

U.S. PATENT DOCUMENTS

| | | | | |
|---|---|---|---|---|
| 4,424,496 | A * | 1/1984 | Nichols | H03F 3/58 330/286 |
| 5,036,335 | A | 7/1991 | Jairam | |
| 5,162,803 | A | 11/1992 | Chen | |
| 5,214,394 | A | 5/1993 | Wong | |
| 5,256,988 | A | 10/1993 | Izadian | |
| 5,736,908 | A | 4/1998 | Alexanian et al. | |
| 5,920,240 | A | 7/1999 | Alexanian et al. | |
| 6,028,483 | A | 2/2000 | Shealy et al. | |
| 6,037,840 | A | 3/2000 | Myer | |
| 6,181,221 | B1 | 1/2001 | Kich et al. | |
| 6,828,875 | B2 | 12/2004 | Channabasappa et al. | |
| 7,110,165 | B2 | 9/2006 | Martin et al. | |
| 7,215,220 | B1 | 5/2007 | Jia | |
| 7,466,203 | B2 | 12/2008 | Rector | |
| 8,698,577 | B2 | 4/2014 | Sherrer et al. | |
| 8,928,429 | B2 | 1/2015 | Song et al. | |
| 9,019,036 | B2 | 4/2015 | Kolias et al. | |
| 9,054,427 | B2 | 6/2015 | Guy et al. | |
| 9,065,163 | B1 | 6/2015 | Wu et al. | |
| 9,276,304 | B2 | 3/2016 | Behan et al. | |
| 9,287,605 | B2 | 3/2016 | Daughenbaugh, Jr. et al. | |
| 9,325,074 | B2 | 4/2016 | Chandler | |
| 9,917,343 | B2 | 3/2018 | Chieh et al. | |
| 9,954,706 | B1 | 4/2018 | Harris et al. | |
| 10,003,118 | B2 | 6/2018 | Kitt | |
| 10,009,067 | B2 | 6/2018 | Birk et al. | |
| 10,164,667 | B1 | 12/2018 | Kitt | |
| 2006/0202777 | A1 | 9/2006 | Deckman et al. | |
| 2007/0229186 | A1 | 10/2007 | Hacker et al. | |
| 2007/0279146 | A1 | 12/2007 | Rector | |
| 2014/0145794 | A1 | 5/2014 | Courtney et al. | |
| 2014/0167880 | A1 | 6/2014 | Daughenbaugh, Jr. et al. | |
| 2017/0149113 | A1 | 5/2017 | Theveneau et al. | |
| 2017/0179598 | A1 | 6/2017 | Kitt | |
| 2018/0294539 | A1 | 10/2018 | Kitt | |
| 2019/0007007 | A1 | 1/2019 | Kitt | |
| 2019/0067778 | A1 | 2/2019 | Mohan | |
| 2019/0067781 | A1 | 2/2019 | Mohan et al. | |
| 2019/0067782 | A1 | 2/2019 | Mohan et al. | |
| 2019/0067783 | A1 | 2/2019 | Mohan et al. | |
| 2019/0068123 | A1 | 2/2019 | Mohan et al. | |
| 2019/0068140 | A1 | 2/2019 | Mohan et al. | |
| 2019/0068141 | A1 | 2/2019 | Yoon et al. | |

OTHER PUBLICATIONS

Caturla, F., et al., "Electroless Plating of Graphite with Copper and Nickel," Journal of the Electrochemical Soceity, vol. 142, Issue 12, Dec. 1995, The Electrochemical Society, Inc., pp. 4084-4090.

Fitzhugh, William, et al., "Modulation of Ionic Current Limitations by Doping Graphite Anodes," Journal of Electrochemical Society, vol. 165, Issue 10, Jul. 2018, The Electrochemical Society, 6 pages.

Larkins, Grover, et al., "Evidence of Superconductivity in Doped Graphite and Graphene," Superconductor Science and Technology, vol. 29, Issue 1, Dec. 2015, IOP Publishing Ltd, 18 pages.

Glenis, S., et al., "Sulfur doped graphite prepared via arc discharge of carbon rods in the presence of thiopenes," Journal of Applied Physics, vol. 86, Issue 8, Oct. 1999, American Institute of Physics, pp. 4464-4466.

Scheike, T., et al., "Can doping graphite trigger room temperature superconductivity: Evidence for granular high-temperature superconductivity in water-treated graphite powder," Advanced Materials, vol. 24, Issue 43, Sep. 2012, 19 pages.

Smalc, Martin, et al., "Thermal Performance of Natural Graphite Heat Spreaders," Proceedings of IPACK2005, Jul. 17-22, San Francisco, California, American Society of Mechanical Engineers, 11 pages.

Notice of Allowance for U.S. Appl. No. 15/637,472, dated Mar. 12, 2019, 7 pages.

Non-Final Office Action for U.S. Appl. No. 15/846,840, dated Mar. 21, 2019, 4 pages.

Non-Final Office Action for U.S. Appl. No. 15/637,472, dated Aug. 10, 2018, 8 pages.

Notice of Allowance for U.S. Appl. No. 15/927,565, dated Aug. 8, 2018, 8 pages.

Non-Final Office Action for U.S. Appl. No. 15/933,783, dated May 1, 2019, 8 pages.

Non-Final Office Action for U.S. Appl. No. 16/042,351, dated Jul. 5, 2019, 5 pages.

Notice of Allowance for U.S. Appl. No. 15/846,840, dated Jul. 5, 2019, 7 pages.

Non-Final Office Action for U.S. Appl. No. 15/981,535, dated Jul. 8, 2019, 5 pages.

Notice of Allowance for U.S. Appl. No. 15/845,225, dated Jan. 10, 2019, 7 pages.

Notice of Allowance for U.S. Appl. No. 16/166,548, dated Nov. 29, 2018, 8 pages.

Non-Final Office Action for U.S. Appl. No. 15/933,821, dated Jul. 11, 2019, 7 pages.

Author Unknown, "Spatial Combining Technology: Revolutionizing the Microwave Power Amplifier," Microwave Journal, Sep. 8, 2008, http://www.microwavejournal.com/articles/print/6838-spatial-combining, CAP Wireless Inc., 7 pages.

Author Unknown, "Vivaldi antenna," Wikipedia, web page last edited Feb. 7, 2017, accessed May 11, 2017, https://en.wikipedia.org/wiki/Vivaldi_antenna, Wikimedia Foundation, Inc., 2 pages.

Courtney, Patrick G. et al., "120 W Ka Band Power Amplifier Utilizing GaN MMICs and Coaxial Waveguide Spatial Power Combining," White Paper, May 2016, Qorvo, pp. 1-8.

Jia, Pengcheng et al., "Broadband High Power Amplifier using Spatial Power Combining Technique" IEEE Transactions on Microwave Theory and Techniques, vol. 51, Issue 12, Dec. 2003, IEEE, 4 pages.

Leggieri, Alberto et al., "The Squarax Spatial Power Combiner," Progress in Electromagnetics Research C, vol. 45, Oct. 2013, EMW Publishing, pp. 43-55.

Ortiz, Sean C., "High Power Spatial Combiners: Tile and Tray Approaches," Dissertation, North Carolina State University, Electrical Engineering, Nov. 2001, 194 pages.

Notice of Allowance for U.S. Appl. No. 15/290,749, dated Feb. 16, 2018, 9 pages.

Amjadi, S., et al., "Design of a Broadband Eight-Way Coaxial Wavelength Power Combiner," IEEE Transactions on Microwave Theory and Techniques, vol. 60, Issue 1, Nov. 15, 2011, pp. 39-45.

Beyers, R., et al., "Compact Conical-Line Power Combiner Design Using Circuit Models," IEEE Transactions on Microwave Theory and Techniques, vol. 62, Issue 11, Oct. 9, 2014, pp. 2650-2658.

Fathy, A., et al., "A Simplified Approach for Radial Power Combiners," IEEE Transactions on Microwave Theory and Techniques, vol. 54, No. 1, Jan. 2006, pp. 247-255.

Gharehkand, F., "Design of a 16 Way Radial Microwave Power Divider/Combiner with Rectangular Waveguide Output and Coaxial Inputs," International Journal of Electronics and Communications (AEU), vol. 68, 2014, pp. 422-428.

Tribak, A., et al., "Ultra-Broadband High Efficiency Mode Converter," Progress in Electromagnetics Research C, vol. 36, 2013, pp. 145-158.

Montgomery, R., et al., "Solid-State PAs Battle TWTAs for ECM Systems," Microwave Journal, Jun. 2017 Supplement, Jun. 14, 2017, 3 pages.

Möttönen, V. S., "Receiver Front-End Circuits and Components for Millimetre and Submillimetre Wavelengths," Dissertation for the degree of Doctor of Science in Technology, Helsinki University of

(56) References Cited

OTHER PUBLICATIONS

Technology, Department of Electrical and Communications Engineering, Radio Laboratory, Apr. 2005, 40 pages.
Non-Final Office Action for U.S. Appl. No. 16/005,794, dated Oct. 7, 2019, 11 pages.
Notice of Allowance for U.S. Appl. No. 16/042,351, dated Nov. 18, 2019, 7 pages.
Non-Final Office Action for U.S. Appl. No. 16/008,586, dated Oct. 24, 2019, 10 pages.
Non-Final Office Action for U.S. Appl. No. 16/191,541, dated Dec. 9, 2019, 7 pages.
Corrected Notice of Allowance and Examiner-Initiated Interview Summary for U.S. Appl. No. 15/846,840, dated Dec. 12, 2019, 6 pages.
Notice of Allowance for U.S. Appl. No. 16/005,794, dated Jan. 9, 2020, 7 pages.
Non-Final Office Action for U.S. Appl. No. 16/032,252, dated Dec. 27, 2019, 5 pages.
Notice of Allowance for U.S. Appl. No. 16/008,586, dated Feb. 4, 2020, 8 pages.
Corrected Notice of Allowance and Applicant-Initiated Interview Summary for U.S. Appl. No. 15/846,840, dated Dec. 31, 2019, 6 pages.
Notice of Allowance for U.S. Appl. No. 15/981,535, dated Dec. 31, 2019, 7 pages.
Notice of Allowance for U.S. Appl. No. 15/933,821, dated Jan. 15, 2020, 7 pages.
Non-Final Office Action for U.S. Appl. No. 16/039,435, dated Jan. 7, 2020, 5 pages.
Final Office Action for U.S. Appl. No. 16/191,541, dated Mar. 31, 2020, 8 pages.
Corrected Notice of Allowability and Examiner-Initiated Interview Summary for U.S. Appl. No. 16/005,794, dated May 26, 2020, 6 pages.
Notice of Allowance for U.S. Appl. No. 16/032,252, dated Jun. 1, 2020, 7 pages.
Notice of Allowance for U.S. Appl. No. 16/039,435, dated Jun. 17, 2020, 8 pages.
Notice of Allowance for U.S. Appl. No. 16/214,234, dated May 15, 2020, 8 pages.
Non-Final Office Action for U.S. Appl. No. 16/288,735, dated May 26, 2020, 9 pages.
Advisory Action, Examiner-Initiated Interview Summary, and AFCP 2.0 Decision for U.S. Appl. No. 16/191,541, dated May 21, 2020, 5 pages.

* cited by examiner

SPATIAL POWER-COMBINING DEVICES AND ANTENNA ASSEMBLIES

RELATED APPLICATION

This application claims the benefit of provisional patent application Ser. No. 62/548,472, filed Aug. 22, 2017, the disclosure of which is hereby incorporated herein by reference in its entirety.

FIELD OF THE DISCLOSURE

The disclosure relates generally to spatial power-combining devices, and more particularly, to an antenna assembly for a spatial power-combining device.

BACKGROUND

Spatial power-combining devices, such as a Qorvo® Spatium® spatial power-combining device, are used for broadband radio frequency power amplification in commercial and defense communications, radar, electronic warfare, satellite, and various other communication systems. Spatial power-combining techniques are implemented by combining broadband signals from a number of amplifiers to provide output powers with high efficiencies and operating frequencies. One example of a spatial power-combining device utilizes a plurality of solid-state amplifier assemblies that form a coaxial waveguide to amplify an electromagnetic signal. Each amplifier assembly may include an input antenna structure, an amplifier, and an output antenna structure. When the amplifier assemblies are combined to form the coaxial waveguide, input antennas may form an input antipodal antenna array, and output antennas may form an output antipodal antenna array.

In operation, an electromagnetic signal is passed through an input port to an input coaxial waveguide section of the spatial power-combining device. The input coaxial waveguide section distributes the electromagnetic signal to be split across the input antipodal antenna array. The amplifiers receive the split signals and in turn transmit amplified split signals across the output antipodal antenna array. The output antipodal antenna array and an output coaxial waveguide section combine the amplified split signals to form an amplified electromagnetic signal that is passed to an output port of the spatial power-combining device.

An antenna for conventional spatial power-combining devices typically includes a metal antenna signal conductor and a metal antenna ground conductor deposited on opposite sides of a substrate, such as a printed circuit board. The printed circuit board provides a desired form factor and mechanical support for the antenna signal conductor and the antenna ground conductor; however, the printed circuit board can become increasingly lossy at higher frequencies, thereby limiting combining efficiency, operating frequency range, and achievable output power of the spatial power-combining device.

SUMMARY

Aspects disclosed herein include spatial power-combining devices and antenna assemblies for spatial power-combining devices. The disclosure relates to spatial power-combining devices with antenna assemblies designed for high efficiency, high or low frequency ranges, ultra-wide bandwidth operation, and high output power.

In some aspects, a spatial power-combining device includes an input coaxial waveguide section, an output coaxial waveguide section, and a center waveguide section that is between the input coaxial waveguide section and the output coaxial waveguide section. The center waveguide section includes an input center waveguide section including an input inner housing and an input outer housing, an output center waveguide section including an output inner housing and an output outer housing, and a core section that forms an integral single component with the input inner housing and the output inner housing. A plurality of amplifiers are registered with the core section.

In some embodiments, the input center waveguide section, the output center waveguide section, and the core section are formed completely of metal. The input inner housing may include a plurality of input signal conductors, and the input outer housing may include a plurality of input ground conductors. The plurality of input signal conductors and the plurality of input ground conductors form an input antenna assembly. In some embodiments, the input antenna assembly includes a plurality of input antennas, wherein each input antenna of the plurality of input antennas includes an input signal conductor of the plurality of input signal conductors and an input ground conductor of the plurality of input ground conductors. Each input antenna of the plurality of input antennas is electromagnetically connected with a corresponding amplifier of the plurality of amplifiers. In a similar manner, the spatial power-combining device may also include an output antenna assembly.

In some aspects, a spatial power-combining device includes an input coaxial waveguide section, an output coaxial waveguide section, a center waveguide section that is between the input coaxial waveguide section and the output coaxial waveguide section. The center waveguide section includes an input center waveguide section including an input inner housing and an input outer housing, an output center waveguide section including an output inner housing and an output outer housing, and a core section that is attached to the input inner housing and the output inner housing. A plurality of amplifiers are registered with the core section. In some embodiments, the core section is attached to the input inner housing and the output inner housing by at least one of a screw or other threaded connection, a bolt, a pin, a press-fit connection, or an adhesive.

In some aspects, a spatial power-combining device structure includes an input antenna assembly including a plurality of input signal conductors and a plurality of input ground conductors, an output antenna assembly including a plurality of output signal conductors and a plurality of output ground conductors, and a core section between the input antenna assembly and the output antenna assembly. The core section forms an integral single component with the plurality of input signal conductors and the plurality of output signal conductors. In some embodiments, the input antenna assembly, the output antenna assembly, and the core section are formed completely of metal.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1A:
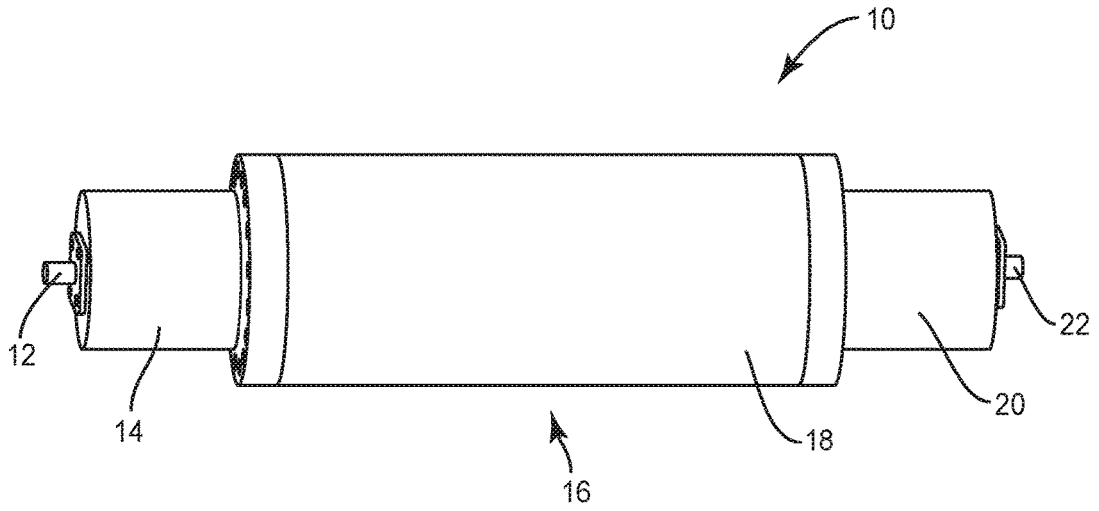
FIG. 1A is a perspective view of a spatial power-combining device according to some embodiments.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Aspects disclosed herein include spatial power-combining devices and antenna assemblies for spatial power-combining devices. The disclosure relates to spatial power-combining devices with antenna assemblies designed for high efficiency, high or low frequency ranges, ultra-wide bandwidth operation, and high output power.

In some embodiments, an antenna assembly may include a signal conductor and a ground conductor that are entirely separated by air. Conventional antenna structures for spatial power-combining devices typically have antenna conductors in the form of patterned metals on opposing sides of a printed circuit board. Separating the antenna conductors entirely by air eliminates any lossy materials of the printed circuit board and, among other advantages, facilitates spatial power-combining devices with antenna structures sized for ultra-broadband microwave operation. The embodiments are particularly adapted to spatial power-combining devices that operate at microwave frequencies, such as, by way of non-limiting example, energy between about 300 megahertz (MHz) and 300 gigahertz (GHz) (0.1 cm wavelength). A spatial power-combining device may operate within one or more common radar bands including, but not limited to, S-band, C-band, X-band, Ku-band, K-band, Ka-band, and Q-band. In some embodiments, by way of non-limiting examples, the operating frequency range includes an operating bandwidth spread of 2 GHz to 20 GHz. In other embodiments, the operating frequency range includes an operating bandwidth spread of 4 GHz to 41 GHz. In still further embodiments, the operating frequency range includes frequencies of 40 GHz and higher, such as operating frequency ranges of 2 GHz to 400 GHz, 20 GHz to 120 GHz, 40 GHz to 400 GHz, and 70 GHz to 400 GHz. Accordingly, an antenna assembly as described herein may be configured to transmit electromagnetic signals above, below, and within a microwave frequency range. For example, in various embodiments, an antenna assembly may transmit electromagnetic signals with frequencies as low as 100 MHz and as high as 400 GHz.

A spatial power-combining device generally includes a plurality of signal paths that include an amplifier connected to an output antenna structure of an output center waveguide. The output antenna structure may comprise an output antenna ground conductor and an output antenna signal conductor that are entirely separated by air. An output coaxial waveguide may be configured to concurrently combine amplified signals from the output antenna structure. Each signal path may further comprise an input antenna structure comprising an input antenna ground conductor and an input antenna signal conductor that are entirely separated by air. An input coaxial waveguide may be configured to provide a signal concurrently to each input antenna structure. The plurality of signal paths may be arranged coaxially about a center axis. Accordingly, the spatial power-combining device may be configured to split, amplify, and combine an electromagnetic signal. Separating the antenna ground conductors and the antenna signal conductors by air eliminates any lossy materials of conventional antenna structures on printed circuit boards and, among other advantages, facilitates spatial power-combining devices with antenna structures sized for ultra-broadband microwave operation.

FIG. 1A is a perspective view of a spatial power-combining device 10 according to some embodiments. The spatial power-combining device 10 includes an input port 12, an input coaxial waveguide section 14, a center waveguide section 16, a center waveguide section cover 18, an output coaxial waveguide section 20, and an output port 22. The input port 12 and the output port 22 may comprise field-replaceable Subminiature A (SMA) connectors. In other embodiments, the input port 12 or the output port 22 may comprise at least one of a super SMA connector, a type N connector, a type K connector, a WR28 connector, other coaxial to waveguide transition connectors, or any other suitable coaxial or waveguide connectors. The input coaxial waveguide section 14 provides a broadband transition from the input port 12 to the center waveguide section 16. Electrically, the input coaxial waveguide section 14 provides broadband impedance matching from an impedance $Z_{p1}$ of the input port 12 to an impedance $Z_c$ of the center waveguide section 16. In a similar manner, the output coaxial waveguide section 20 provides broadband impedance matching from the impedance $Z_c$ of the center waveguide section 16 to an impedance $Z_{p2}$ of the output port 22.

Figure 1B:
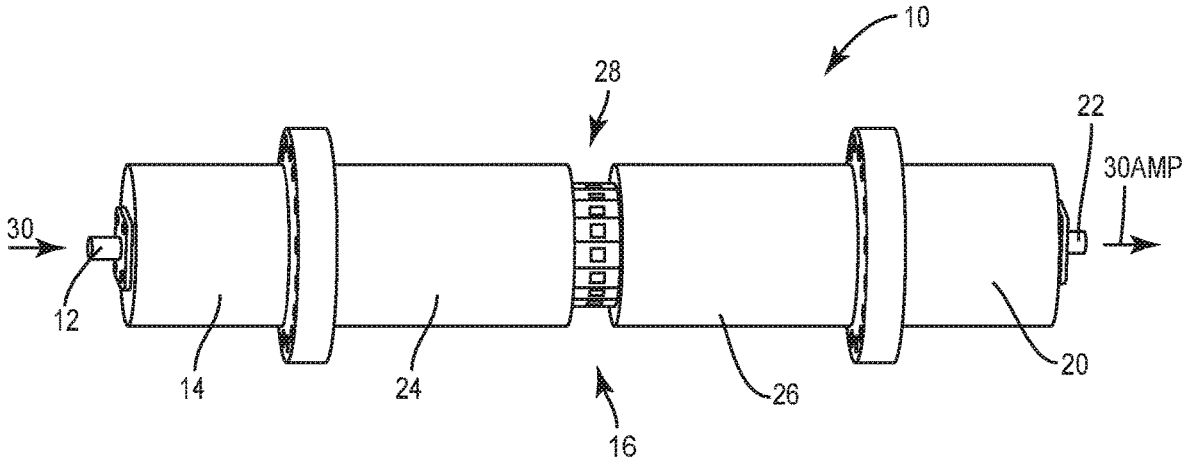
FIG. 1B is a perspective view of the spatial power-combining device of FIG. 1A with the center waveguide cover removed.

FIG. 1B is a perspective view of the spatial power-combining device 10 of FIG. 1A with the center waveguide section cover 18 removed. As illustrated, the center waveguide section 16 includes an input center waveguide section 24 and an output center waveguide section 26. A plurality of amplifiers 28 are located between the input center waveguide section 24 and the output center waveguide section 26. In operation, an input signal 30 is presented to the input port 12 and transmitted through the input coaxial waveguide section 14 to the input center waveguide section 24. The input center waveguide section 24 is configured to provide the input signal 30 concurrently to each amplifier of the plurality of amplifiers 28 for amplification. The plurality of amplifiers 28 transmit amplified signals portion to the output center waveguide section 26 and the output coaxial waveguide section 20 that operate to combine the amplified signal portions to form an amplified output signal $\mathbf{30}_{AMP}$, which is then propagated to the output port 22.

In some embodiments, the plurality of amplifiers 28 comprise an array of Monolithic Microwave Integrated Circuit (MMIC) amplifiers. In some embodiments, each MMIC may include a solid-state Gallium Nitride (GaN)-based MMIC. A GaN MMIC device provides high power density and bandwidth, and a spatial power-combining device may combine power from an array of GaN MMICs efficiently in a single step to minimize combining loss.

Figure 2A:
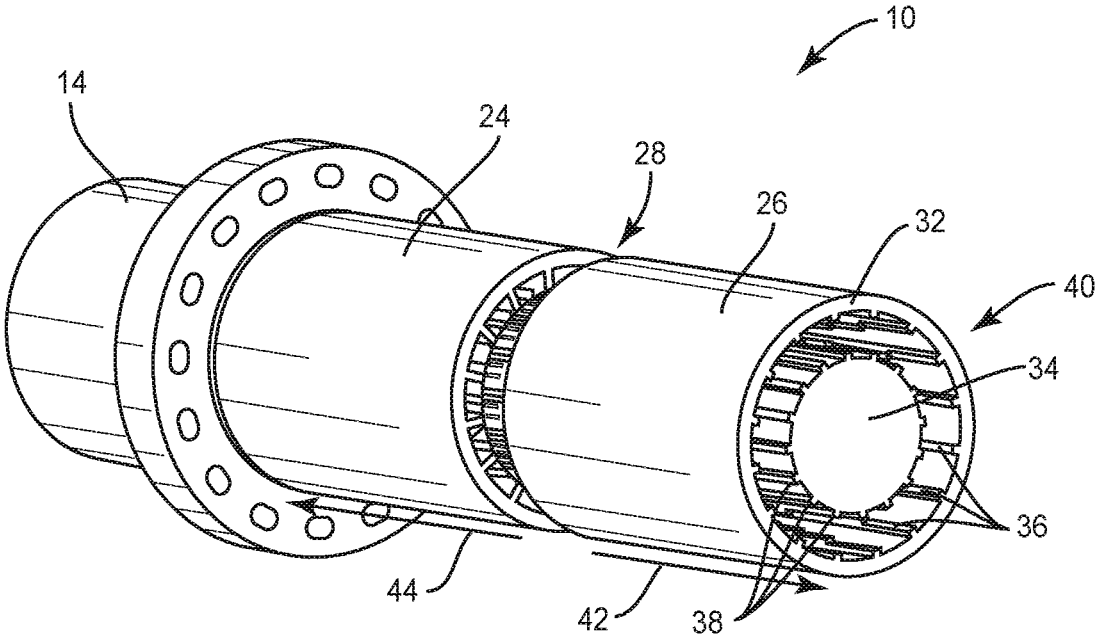
FIG. 2A is a partial perspective view of the spatial power-combining device of FIG. 1B with the output coaxial waveguide section and the output port removed.

FIG. 2A is a partial perspective view of the spatial power-combining device 10 of FIG. 1B with the output coaxial waveguide section 20 and the output port 22 removed. The output center waveguide section 26 comprises an output outer housing 32 and an output inner housing 34. The output outer housing 32 comprises a plurality of output ground conductors 36, and the output inner housing 34 comprises a plurality of output signal conductors 38. The combination of the plurality of output signal conductors 38 and the plurality of output ground conductors 36 form an output antenna assembly 40. As will later be illustrated in more detail, the plurality of output ground conductors 36 and the plurality of output signal conductors 38 diverge away from each other in a first direction 42 from the plurality of amplifiers 28. In some embodiments, the configuration of the input center waveguide section 24 would mirror the output center waveguide section 26 extending in a second direction 44 from the plurality of amplifiers 28 opposite the first direction 42 and toward the input coaxial waveguide section 14; accordingly, the elements would be renamed by replacing the term "output" with the term "input."

Figure 2B:
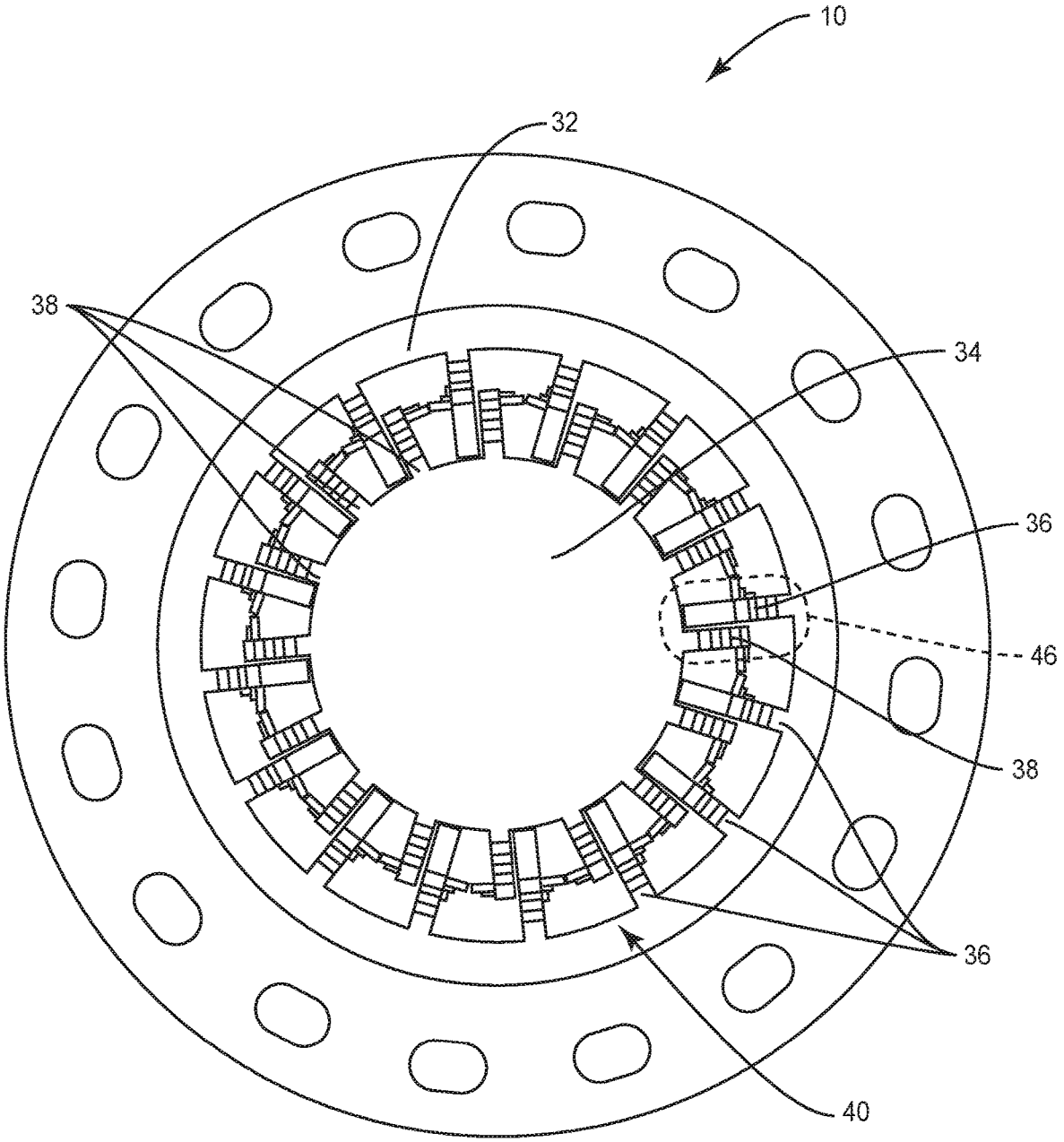
FIG. 2B is a partial end view of the spatial power-combining device of FIG. 2A.

FIG. 2B is a partial end view of the spatial power-combining device 10 of FIG. 2A. The output antenna assembly 40 forms a plurality of output antennas 46 where each output antenna 46 comprises an output signal conductor 38 of the plurality of output signal conductors 38 and an output ground conductor 36 of the plurality of output ground conductors 36. Each output antenna 46 is electromagnetically connected with a corresponding amplifier of the plurality of amplifiers (28 in FIG. 2A). The plurality of output ground conductors 36 are mechanically supported to the output outer housing 32, and the plurality of output signal conductors 38 are mechanically supported to the output inner housing 34. This allows each output antenna 46 to include an output ground conductor 36 and an output signal conductor 38 that are entirely separated by air. This may be accomplished by forming the plurality of output signal conductors 38 and the plurality of output ground conductors 36 with metal that is thick enough to not require a supporting substrate, such as a printed circuit board. In some embodiments, the metal may comprise a same metal as the output inner housing 34 and the output outer housing 32. The metal may comprise many different metals, including for example, Aluminum (Al) or alloys thereof, or Copper (Cu) or alloys thereof. Accordingly, the lossy materials of conventional antenna structures on printed circuit boards are eliminated. This also provides the ability to scale up antenna configurations for lower frequency ranges or scale down antenna configurations for higher frequency ranges not previously attainable. Among other advantages, a spatial power-combining device may include antenna structures sized for ultra-broadband microwave operation.

In some embodiments, the output ground conductors 36 and the output outer housing 32 are an integral single component, and the output signal conductors 38 and the output inner housing 34 are an integral single component. In other embodiments, the output ground conductors 36 and the output signal conductors 38 may be formed separately and attached to the output outer housing 32 and the output inner housing 34, respectively. In other embodiments, the order may be reversed in which the output outer housing 32 comprises output signal conductors and the output inner housing 34 comprises output ground conductors. As with FIG. 2A, it is understood the description of FIG. 2B would applicable for the input center waveguide section (24 in FIG. 2A) in some embodiments; accordingly, the elements would be renamed by replacing the term "output" with the term "input."

Figure 3A:
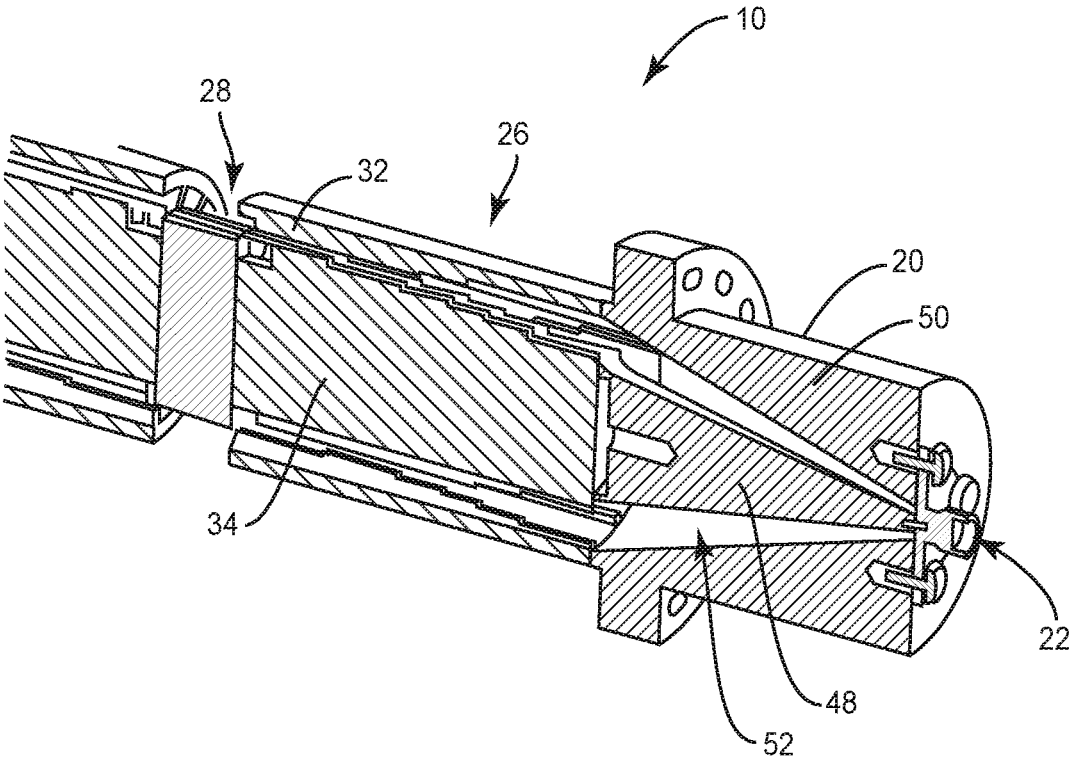
FIG. 3A is a partial cross-sectional view of the spatial power-combining device of FIG. 2A including the plurality of amplifiers, the output center waveguide section, the output coaxial waveguide section, and the output port.

FIG. 3A is a partial cross-sectional view of the spatial power-combining device 10 of FIG. 2A including the plurality of amplifiers 28, the output center waveguide section 26, the output coaxial waveguide section 20, and the output port 22. The output coaxial waveguide section 20 comprises an output inner conductor 48 and an output outer conductor 50 with gradually changing profiles configured to reduce impedance mismatch from the output port 22 and the output center waveguide section 26. An opening 52 is formed between the output inner conductor 48 and the output outer conductor 50 and comprises a conical shape. At least a portion of the output inner conductor 48 is in alignment with the output inner housing 34 and at least a portion of the output outer conductor 50 is in alignment with the output outer housing 32.

Figure 3B:
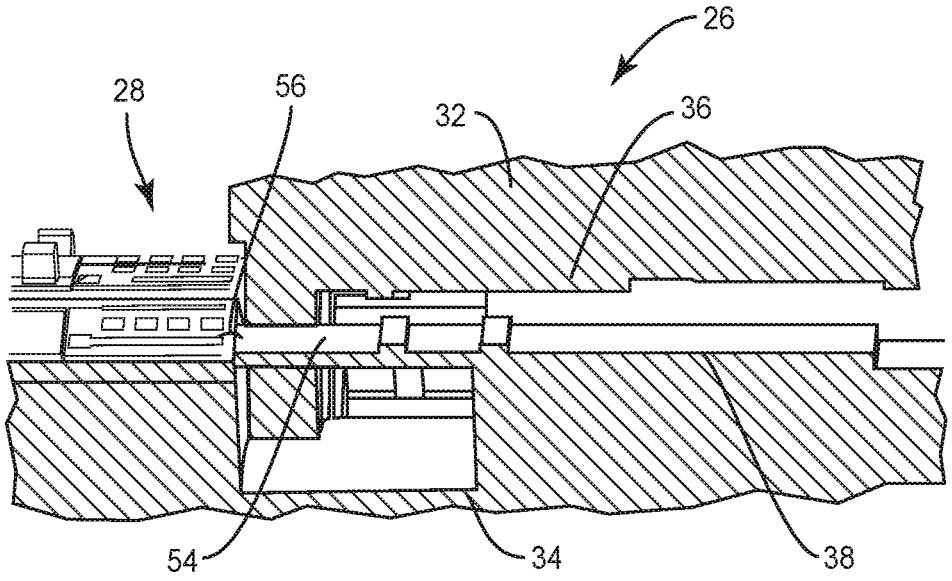
FIG. 3B is a close-up view of a transition between the output center waveguide section and the plurality of amplifiers of the spatial power-combining device of FIG. 3A.

FIG. 3B is a close-up view of a transition between the output center waveguide section 26 and the plurality of amplifiers 28 of the spatial power-combining device 10 of FIG. 3A. The output signal conductor 38 of the output inner housing 34 comprises a connector 54 for making an electrical connection 56 to a corresponding amplifier 28 of the plurality of amplifiers 28. In some embodiments, the connector 54 is an integral single component with the output signal conductor 38 and the output inner housing 34. The electrical connection 56 may comprise a transmission line including a wire, a wire bond, or any other component that functions to transition energy from a planar medium of the corresponding amplifier 28 to an orthogonal direction of the output signal conductor 38 and the output ground conductor 36. Only a portion of the output outer housing 32 and the output inner housing 34 are illustrated. As before, it is understood that in some embodiments, the details of the input side of the device 10 are the same as those of the output side extending in an opposite direction (44 of FIG. 2A) from the plurality of amplifiers 28. Accordingly, a second transmission line may connect between an input signal conductor and the corresponding amplifier 28 of the plurality of amplifiers 28.

FIGS. 4A-4D are perspective views of either an input center waveguide section or an output center waveguide section. For brevity, FIGS. 4A-4D will be described with respect to the output center waveguide section 26 of FIG. 1B; however, it is understood the same description could also apply to the input center waveguide section 24 of FIG. 1B by replacing the term "output" with the term "input."

Figure 4A:
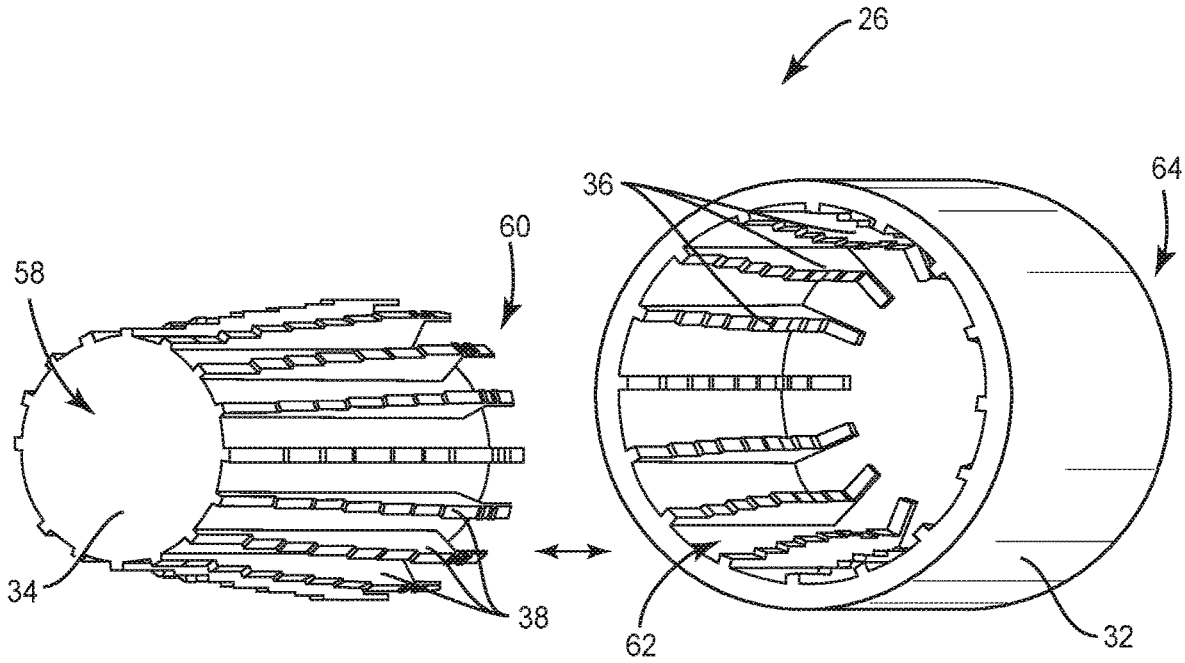
FIG. 4A is an exploded perspective view of the output center waveguide section of FIG. 1B.
Figure 4B:
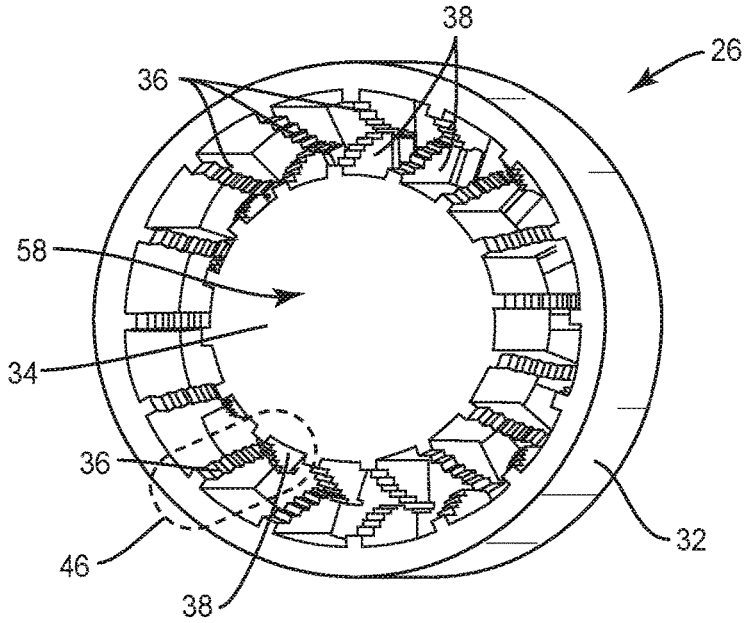
FIG. 4B is an assembled perspective view of the output center waveguide section of FIG. 1B.

FIG. 4A is an exploded perspective view of the output center waveguide section 26 of FIG. 1B. The output inner housing 34 is illustrated spaced apart from the output outer housing 32 to provide a detailed view of the plurality of output signal conductors 38 and the plurality of output ground conductors 36, respectively. As shown, the plurality of output signal conductors 38 have a profile that gradually increases from a first end 58 of the output inner housing 34 to a second end 60 of the output inner housing 34. In a similar manner, the plurality of output ground conductors 36 have a profile that gradually increases from a first end 62 of the output outer housing 32 to a second end 64 of the output outer housing 32. FIG. 4B is an assembled perspective view of the output center waveguide section 26 of FIG. 1B. The output outer housing 32 surrounds the output inner housing 34. The plurality of output ground conductors 36 extend from the output outer housing 32 toward the output inner housing 34 in an alternating arrangement with the plurality of output signal conductors 38 that extend from the output inner housing 34 toward the output outer housing 32. Accordingly, the plurality of output antennas 46 are formed between the output outer housing 32 and the output inner housing 34, and each output antenna 46 includes a corresponding output ground conductor 36 and a corresponding output signal conductor 38. The first end 58 of the output inner housing 34 is configured to be arranged closest to the output coaxial waveguide section (20 of FIG. 3A).

Figure 4C:
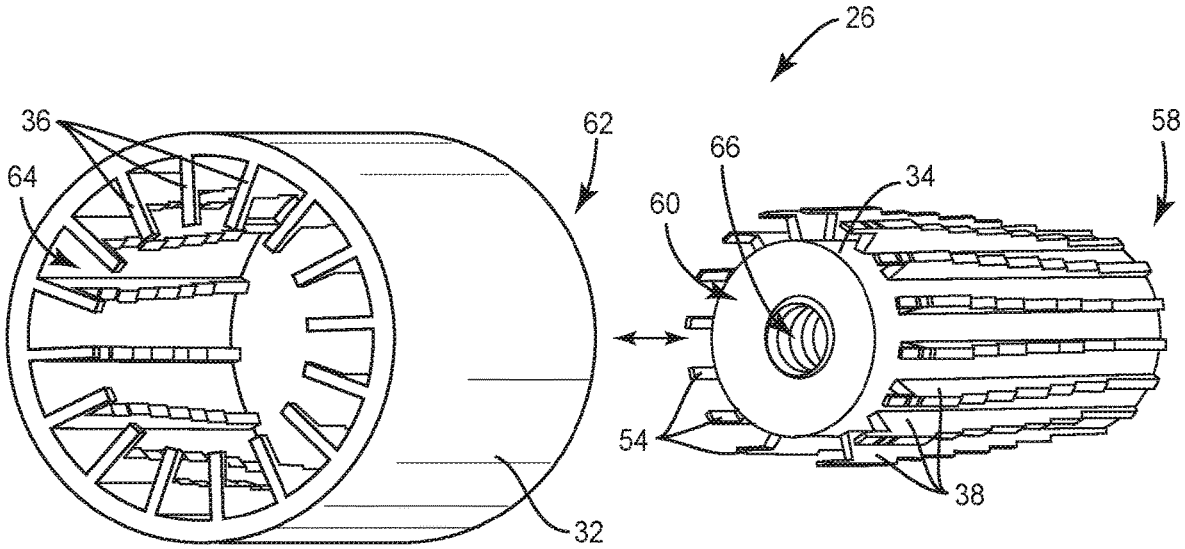
FIG. 4C is an exploded perspective view of the output center waveguide section of FIG. 4A, from an alternative perspective.
Figure 4D:
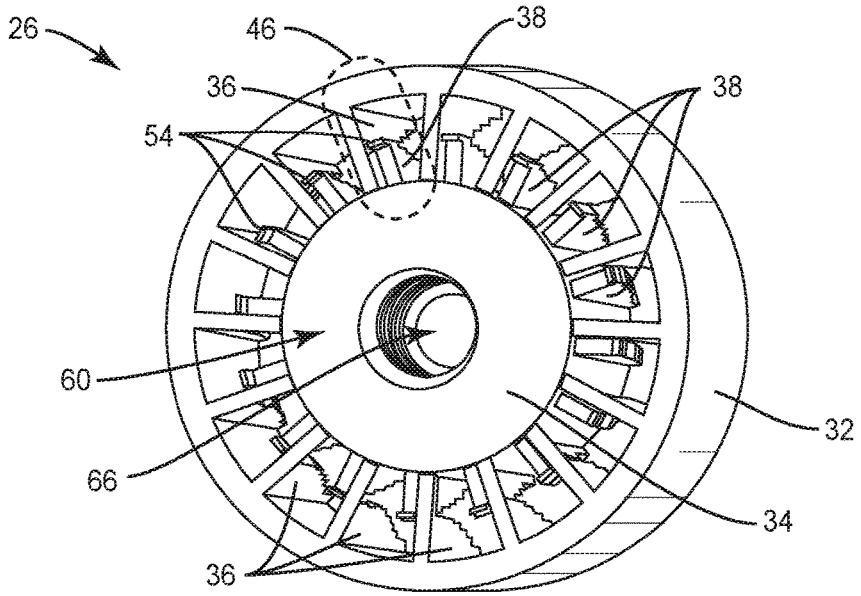
FIG. 4D is an assembled perspective view of the output center waveguide section of FIG. 4C.

FIG. 4C is an exploded perspective view of the output center waveguide section 26 of FIG. 4A, from an alternative perspective. In FIG. 4C, the second end 64 of the output outer housing 32 and the second end 60 of the output inner housing 34 are visible. At the second end 64 of the output outer housing 32, the plurality of output ground conductors 36 extend farther away from the output outer housing 32 than at the first end 62. In a similar manner, the plurality of output signal conductors 38 have a profile that gradually increases from the first end 58 to the second end 60 of the output inner housing 34. Additionally, each of the plurality of output signal conductors 38 includes the connector 54 as previously described that is configured for making an electrical connection with a corresponding amplifier. In some embodiments, the output inner housing 34 includes an attachment feature 66 that is configured for attaching the output inner housing 34 with other components of the spatial power-combining device. In some embodiments, the attachment feature 66 comprises a threaded receptacle configured to receive a screw. In other embodiments, the attachment feature 66 may comprise a protruding screw, a bolt, a pin, or a receptacle configured to receive a bolt or a pin. FIG. 4D is an assembled perspective view of the output center waveguide section 26 of FIG. 4C. The output outer housing 32 surrounds the output inner housing 34 that includes the attachment feature 66. The plurality of output ground conductors 36 are configured in an alternating arrangement with the plurality of output signal conductors 38 to form a plurality of output antennas 46 between the output outer housing 32 and the output inner housing 34. Each output antenna 46 includes a corresponding output ground conductor 36, a corresponding output signal conductor 38, and a corresponding connector 54. The second end 60 of the output inner housing 34 is configured to be arranged closest to the plurality of amplifiers (28 of FIG. 3A).

Figure 5:
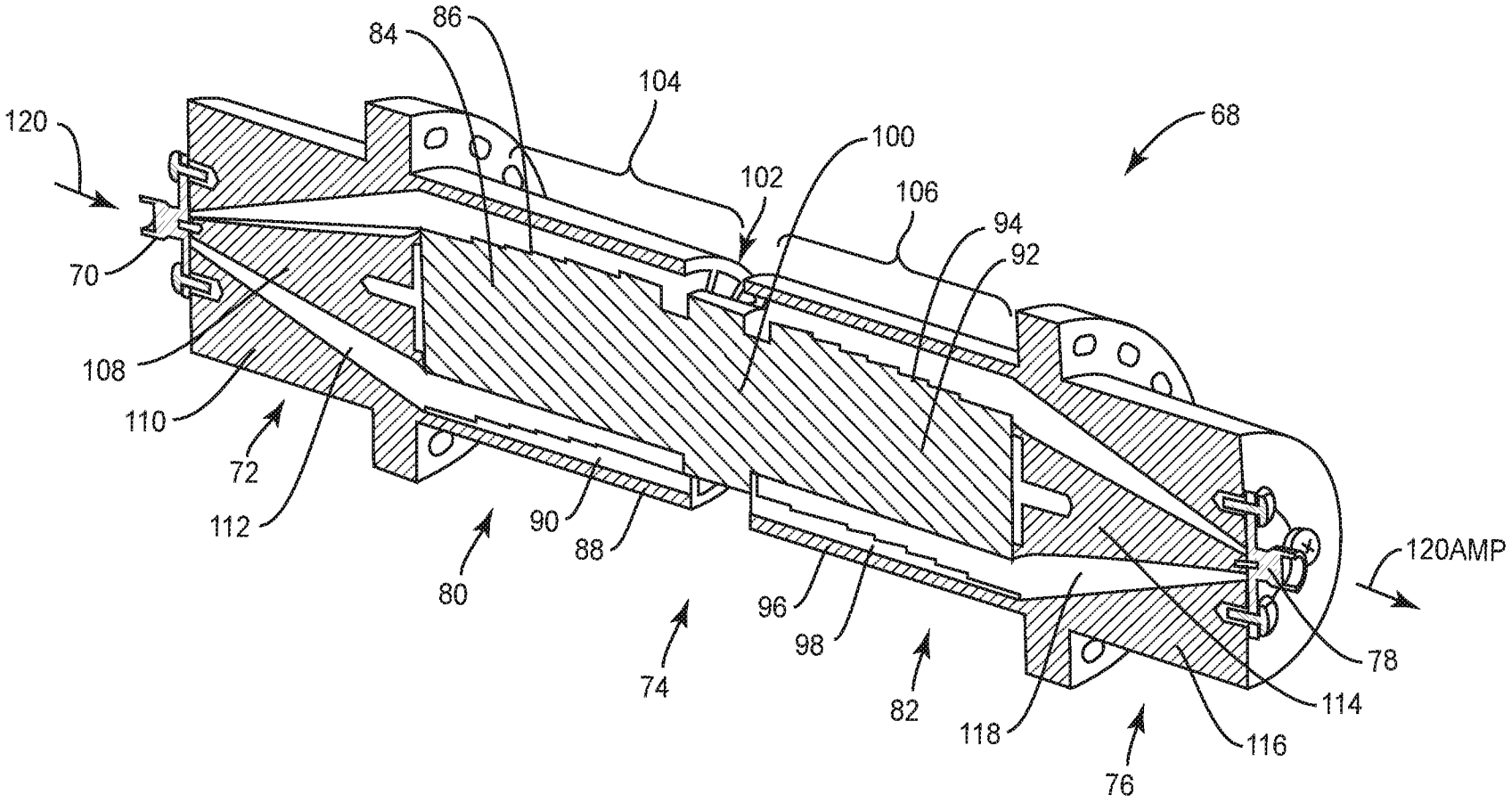
FIG. 5 is a cross-sectional view of a spatial power-combining device according to some embodiments.

FIG. 5 is a cross-sectional view of a spatial power-combining device 68 according to some embodiments. The spatial power-combining device 68 includes an input port 70, an input coaxial waveguide section 72, a center waveguide section 74, an output coaxial waveguide section 76, and an output port 78. The center waveguide section 74 includes an input center waveguide section 80 and an output center waveguide section 82. The input center waveguide section 80 includes an input inner housing 84 that includes a plurality of input signal conductors 86 that are radially arranged and protrude outward from the input inner housing 84. The input center waveguide section 80 also includes an input outer housing 88 that includes a plurality of input ground conductors 90 that are radially arranged and protrude inward from the input outer housing 88. In a similar manner, the output center waveguide section 82 includes an output inner housing 92 that includes a plurality of output signal conductors 94 that are radially arranged and protrude outward from the output inner housing 92. The output center waveguide section 82 also includes an output outer housing 96 that includes a plurality of output ground conductors 98 that are radially arranged and protrude inward from the output outer housing 96. Based on where the cross-section is taken, not all of the plurality of input signal conductors 86, the plurality of input ground conductors 90, the plurality of output signal conductors 94, or the plurality of output ground conductors 98 are visible. In some embodiments, the input outer housing 88 is an integral single component with the input coaxial waveguide section 72, and the output outer housing 96 is an integral single component with the output coaxial waveguide section 76. In other embodiments, the input outer housing 88 and the output outer housing 96 are formed separately and later attached to the input coaxial waveguide section 72 and the output coaxial waveguide section 76, respectively.

In FIG. 5, a core section 100 is configured between the input inner housing 84 and the output inner housing 92, and a plurality of amplifiers 102 are registered with the core section 100. In some embodiments, the core section 100 forms an integral single component with the input inner housing 84 and the output inner housing 92. For example, the core section 100, the input inner housing 84, and the output inner housing 92 may be formed completely from a metal, such as Al or alloys thereof, or Cu or alloys thereof. The metal may be machined as an integral single component that includes the core section 100 between the input inner housing 84 and the output inner housing 92. In other words, the core section 100, the input inner housing 84, and the output inner housing 92 may comprise a continuous material, such as metal. Additionally, the input outer housing 88 and the output outer housing 96 may also be formed completely of metal. In that regard, the input center waveguide section 80, the output center waveguide section 82, and the core section 100 of the spatial power-combining device 68 may all be formed completely of metal.

The plurality of input signal conductors 86 and the plurality of input ground conductors 90 form an input antenna assembly 104. The plurality of output signal conductors 94 and the plurality of output ground conductors 98 form an output antenna assembly 106. In that regard, spatial power-combining device structures may include the input antenna assembly 104 comprising the plurality of input signal conductors 86 and the plurality of input ground conductors 90, the output antenna assembly 106 comprising the plurality of output signal conductors 94 and the plurality of output ground conductors 98, and the core section 100 that is between the input antenna assembly 104 and the output antenna assembly 106. In some embodiments, the core section 100 forms an integral single component with the plurality of input signal conductors 86 and the plurality of output signal conductors 94. In some embodiments, the input antenna assembly 104, the output antenna assembly 106, and the core section 100 are formed completely of metal, such as Al or alloys thereof, or Cu or alloys thereof.

In FIG. 5, the input coaxial waveguide section 72 includes an input inner conductor 108 and an input outer conductor 110 with gradually changing profiles configured to reduce impedance mismatch from the output port 78 and the input center waveguide section 80. An opening 112 is formed between the input inner conductor 108 and the input outer conductor 110 and a portion of the opening 112 is aligned between the input inner housing 84 and the input outer housing 88. In a similar manner the output coaxial waveguide section 76 includes an output inner conductor 114, an output outer conductor 116, and an opening 118 therebetween.

In operation, an input signal 120 is received at the input port 70. The input signal 120 then propagates through the opening 112 of the input coaxial waveguide section 72 to the input antenna assembly 104. The input signal 120 is split across the input antenna assembly 104 and is concurrently distributed in a substantially even manner to each amplifier of the plurality of amplifiers 102. The plurality of amplifiers 102 concurrently amplify respective portions of the input signal 120 to generate amplified signal portions. The plurality of amplifiers 102 transmit the amplified signal portions to the output antenna assembly 106 where they are guided to the opening 118 of the output coaxial waveguide section 76. The amplified signal portions are combined to form an amplified output signal $\mathbf{120}_{AMP}$, which is then propagated through the output port 78. In some embodiments, the input port 70, the input coaxial waveguide section 72, the input antenna assembly 104, the output antenna assembly 106, the output coaxial waveguide section 76, and the output port 78 are all formed completely of metal. In this manner, the entire structure that the electromagnetic signal passes through before and after the plurality of amplifiers 102 is metal. Accordingly, losses associated with conventional antenna structures that use printed circuit boards are eliminated. This allows spatial power-combining devices with higher frequency ranges of operation.

An all-metal configuration further provides the ability to scale the dimensions down for higher frequency ranges or scale the dimensions up for lower frequency ranges. For example, for a lower frequency range of about 350 MHz to about 1100 MHz, the spatial power-combining device 68 may comprise a length of about 50 inches from the input port 70 to the output port 78 and a diameter of the center waveguide section 74 of about 20 inches. For a medium frequency range of about 2 GHz to about 20 GHz, the spatial power-combining device 68 may be scaled to comprise a length of about 9 inches from the input port 70 to the output port 78 and a diameter of the center waveguide section 74 of about 2.3 inches. For a high frequency range of about 20 GHz to about 120 GHz, the spatial power-combining device 68 may be scaled to comprise a length of about 0.75 inches from the input port 70 to the output port 78 and a diameter of the center waveguide section 74 of about 0.325 inches. For an ultra-high frequency range of about 70 GHz to about 400 GHz, the spatial power-combining device 68 may be scaled to comprise a length of about 0.250 inches from the input port 70 to the output port 78 and a diameter of the center waveguide section 74 of about 0.1 inches. Accordingly, a spatial power-combining device may comprise the same structure, only with relative dimensions scaled up or down, and achieve any of the above frequency ranges.

An all-metal design additionally provides improved thermal capabilities that allow better power-handling for spatial power-combining devices. For example, in some embodiments, the plurality of amplifiers 102 are mounted on the core section 100 that comprises a highly thermally conductive material, such as metal. As previously described, the rest of the spatial power-combining device 68 may also comprise a highly thermally conductive material, such as metal. In operation, the core section 100 as well as other components of the spatial power-combining device 68 serve as a heat sink for heat generated by the plurality of amplifiers 102. Accordingly, the spatial power-combining device 68 has improved thermal capabilities that allow higher temperature operation with increased efficiency and higher overall output power.

Figure 6:
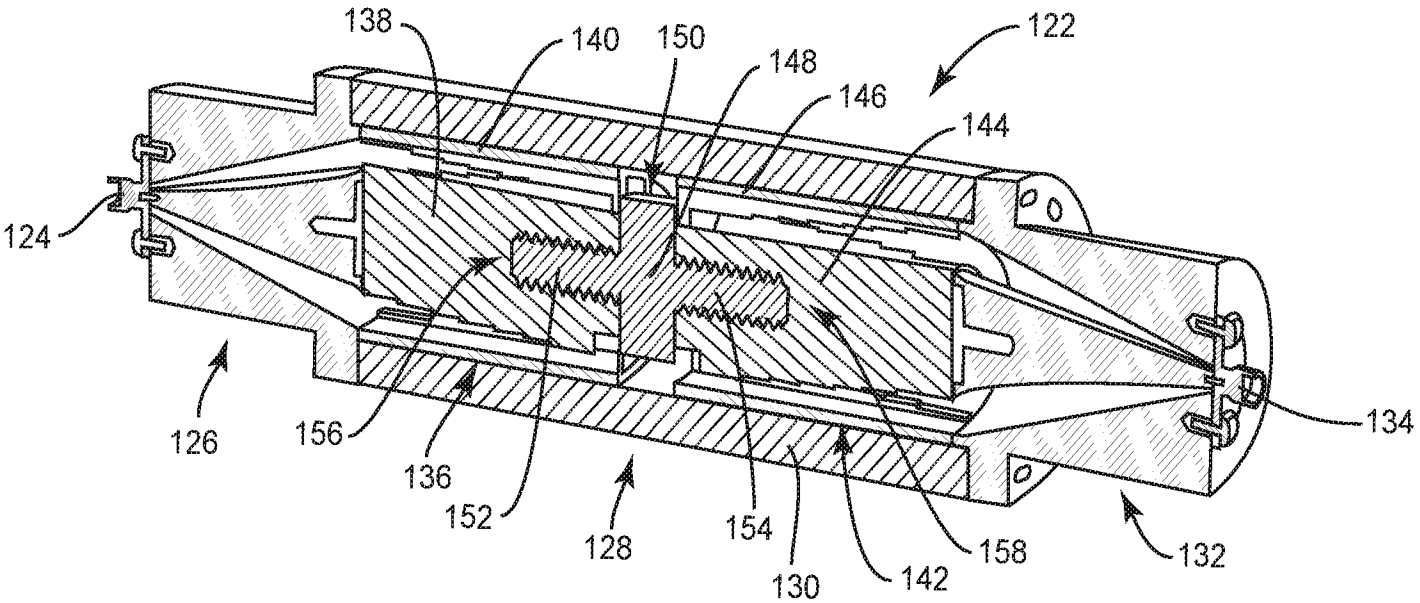
FIG. 6 is a cross-sectional view of a spatial power-combining device according to some embodiments.

FIG. 6 is a cross-sectional view of a spatial power-combining device 122 according to some embodiments. The spatial power-combining device 122 includes an input port 124, an input coaxial waveguide section 126, a center waveguide section 128, a center waveguide section cover 130, an output coaxial waveguide section 132, and an output port 134. The center waveguide section 128 comprises an input center waveguide section 136 that includes an input inner housing 138 and an input outer housing 140. The center waveguide section 128 additionally comprises an output center waveguide section 142 that includes an output inner housing 144 and an output outer housing 146. The center waveguide section 128 further comprises a core section 148 that is attached to the input inner housing 138 and the output inner housing 144. A plurality of amplifiers 150 are registered with the core section 148. In some embodiments, the core section 148 may be mechanically attached to the input inner housing 138 and the output inner housing 144. In FIG. 6, the core section 148 comprises a first protrusion 152 configured to mechanically attach with the input inner housing 138 and a second protrusion 154 configured to mechanically attach with the output inner housing 144. The first protrusion 152 and the second protrusion 154 are illustrated as threaded screws for mechanical attachment into threaded receptacles 156 and 158 of the input inner housing 138 and the output inner housing 144 respectively. In other embodiments, additional screws, one or more bolts, one or more pins, a press-fit connection, or an adhesive material may be used to attach the core section 148 to the input inner housing 138 and the output inner housing 144. Any of the other components of the spatial power-combining device 122 and the operation of the spatial power-combining device 122 may be similar to the previously-provided description of the spatial power-combining device 68 of FIG. 5.

As previously described, a spatial power-combining device with an all-metal design allows scalability for higher or lower frequency ranges that were not previously possible with conventional antenna structures. For example, for frequencies above about 20 GHz, the dimensional requirements of an individual antenna may be so small that they fall below minimum thickness limitations for printed circuit boards. Additionally, for frequencies below 1 or 2 GHz, the dimensional requirements of an individual antenna become larger than conventional antenna arrangements on printed circuit boards. An all-metal antenna allows flexibility to design spatial power-combining devices for a wide range of operation frequencies.

Figure 7A:
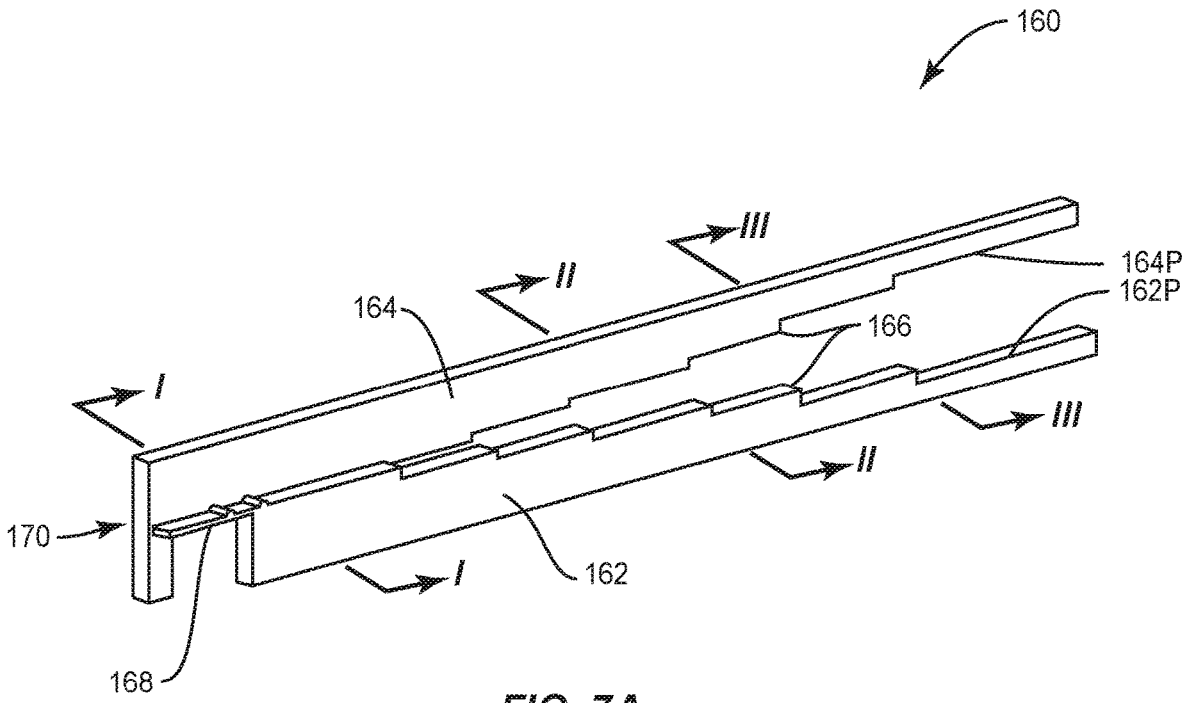
FIG. 7A is a perspective view of an antenna structure according to some embodiments.

FIG. 7A is a perspective view of an antenna structure 160 according to some embodiments. The antenna structure 160 includes a signal conductor 162 with a first profile 162P and a ground conductor 164 with a second profile 164P that diverge away from each other along parallel planes in a lengthwise direction. The signal conductor 162 and the ground conductor 164 may additionally include tuning features 166 configured for a desired operating frequency and an operating bandwidth. In FIG. 7A, tuning features 166 are configured in a continuously decreasing stepwise manner as the signal conductor 162 and the ground conductor 164 diverge away from each other. Accordingly, the first profile 162P and the second profile 164P may diverge from one another in a stepwise manner. However, many different profiles are possible depending on the desired frequency and bandwidth operation. For example, the tuning features 166 may comprise steps that increase and decrease at various points along the first profile 162P and the second profile 164P. Additionally, the first profile 162P and the second profile 164P may diverge from one another in a continuous manner without steps.

As in previous embodiments, the signal conductor 162 may additionally include a connector 168 for transmitting or receiving a signal to or from an amplifier. The connector 168 may be a single piece or integral with the signal conductor 162, or it may be formed separately. The connector 168 is a transition area for the antenna structure 160 to transmit or receive a signal, such as a signal with frequency in the microwave range or higher. The antenna structure 160 may comprise a metal with a thickness such that a substrate is not required for support, thereby an air gap 170 is maintained entirely between the signal conductor 162 and the ground conductor 164. Accordingly, the signal conductor 162 and the ground conductor 164 are entirely separated by air.

Figure 7B:
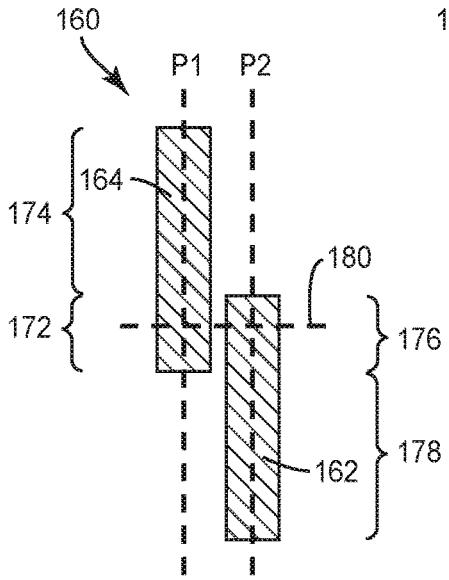
FIG. 7B is a cross-sectional view of the antenna structure of FIG. 7A.
Figure 7C:
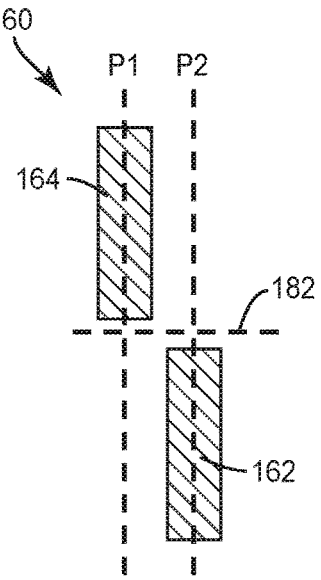
FIG. 7C is a cross-sectional view of the antenna structure of FIG. 7A.
Figure 7D:
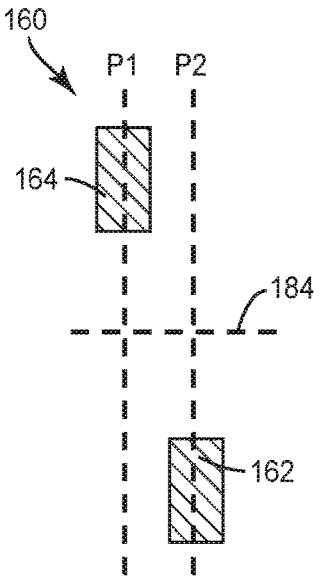
FIG. 7D is a cross-sectional view of the antenna structure of FIG. 7A.

FIGS. 7B, 7C, and 7D represent various cross-sections taken along section lines I-I, II-II, and III-III, respectively, of the antenna structure 160 of FIG. 7A in which the ground conductor 164 and the signal conductor 162 diverge away from each other along a lengthwise direction. As shown, the ground conductor 164 is a planar structure positioned in a first plane P1, and the signal conductor 162 is a planar structure positioned in a second plane P2, and the first plane P1 is parallel to the second plane P2. The ground conductor 164 comprises a ground conductor overlapping portion 172 and a ground conductor non-overlapping portion 174. The signal conductor 162 comprises a signal conductor overlapping portion 176 and a signal conductor non-overlapping portion 178. In FIG. 7B, a first line 180 perpendicular to the first plane P1 intersects the ground conductor overlapping portion 172 and the signal conductor overlapping portion 176. As the ground conductor 164 and signal conductor 162 diverge away from each other along the lengthwise direction of the antenna structure, there are cross-sections where no line perpendicular to the first plane P1 intersects any portion of both the ground conductor 164 and the signal conductor 162. For example, in the cross-sections of FIGS. 7C and 7D, a second line 182 and a third line 184, respectively, represent perpendicular lines closest to both the ground conductor 164 and the signal conductor 162.

It is understood that the antenna structure 160 of FIGS. 7A to 7D may be configured to comprise an input antenna structure or an output antenna structure as described in previous embodiments. Accordingly, the ground conductor 164 may be configured as an input ground conductor with an input ground conductor overlapping portion and an input ground conductor non-overlapping portion or an output ground conductor with an output ground conductor overlapping portion and an output ground conductor non-overlapping portion. The signal conductor 162 may be configured as an input signal conductor with an input signal conductor overlapping portion and an input signal conductor non-overlapping portion or an output signal conductor with an output signal conductor overlapping portion and an output signal conductor non-overlapping portion.

Figure 8:
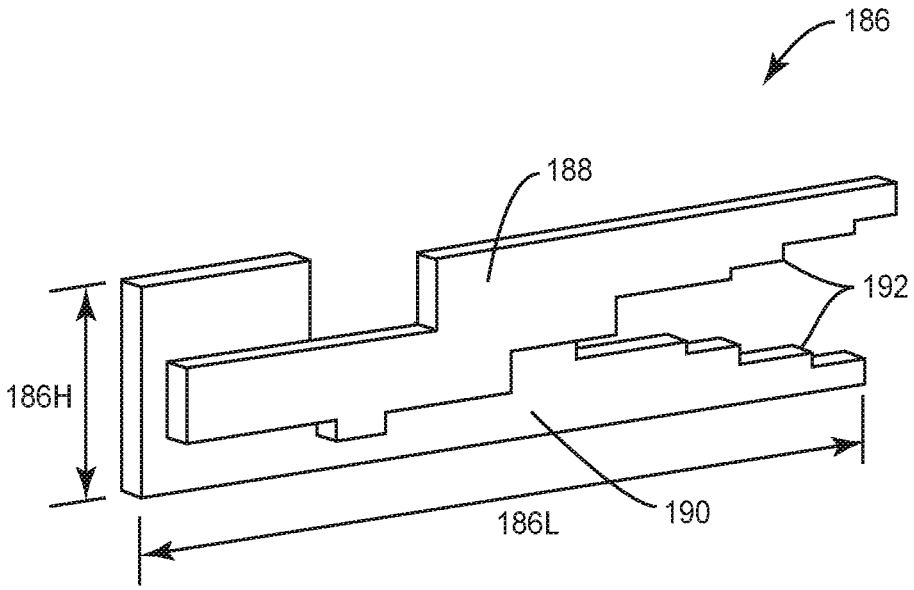
FIG. 8 is a perspective view of an antenna structure according to some embodiments.
Figure 9:
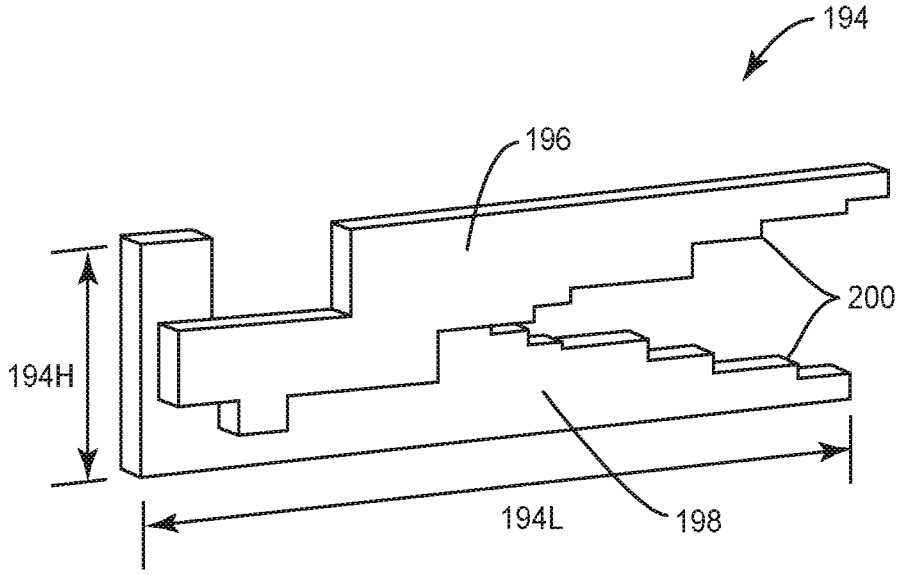
FIG. 9 is a perspective view of an antenna structure according to some embodiments.
Figure 10:
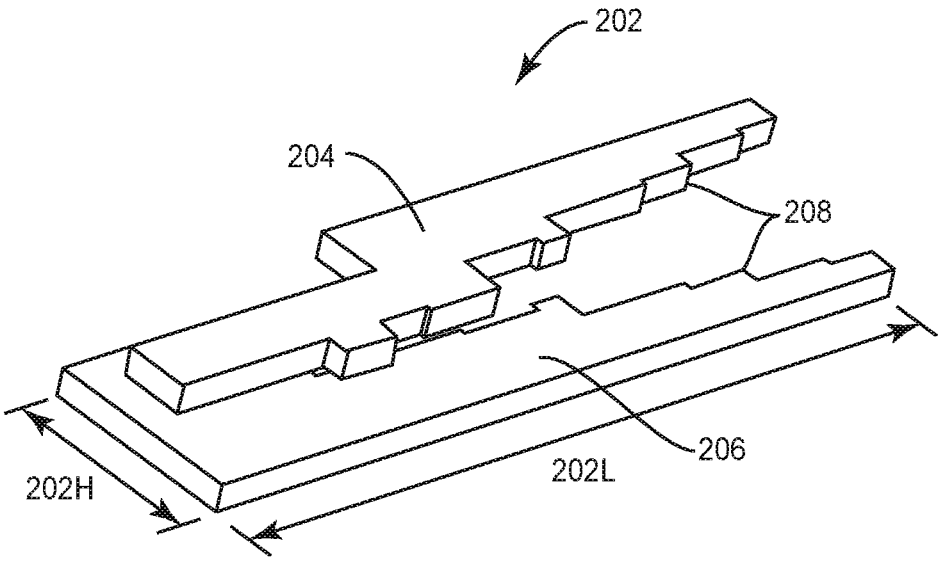
FIG. 10 is a perspective view of an antenna structure according to some embodiments.

As previously described, a spatial power-combining device may include an antenna assembly that includes at least one antenna in which a conventional substrate is removed and the signal and ground conductors are separated entirely by air. This configuration provides the ability to scale down designs for higher frequency ranges not previously attainable. For example, an antenna structure 186 of FIG. 8 comprises a signal conductor 188, a ground conductor 190, and tuning features 192 that are scaled to provide an operating range of 20 GHZ to 120 GHz. For example, the antenna structure 186 may have a length 186L of about 6-7 millimeters (mm) and a height 186H of about 1-2 mm. In FIG. 9, an antenna structure 194 comprises a signal conductor 196, a ground conductor 198, and tuning features 200 that are scaled down further to provide an operating range of 70 GHz to 400 GHz. For example, the antenna structure 194 may have a length 194L of about 1-2 mm and a height 194H of about 0.3-0.6 mm. In both designs, the impedance along the antenna structure may transform from 50 ohms to 375 ohms. While this scalability is advantageous for high-frequency designs, it is also applicable for lower frequency applications. For example, an antenna structure 202 of FIG. 10 comprises a signal conductor 204, a ground conductor 206, and tuning features 208 that are larger than those in FIG. 8 and FIG. 9 and may be configured for operation below 1 GHz. For example, the antenna structure 202 may have a length 202L of about 610-640 mm and a height 202H of about 150-160 mm. It is understood that the antenna structures 186, 194, and 202 of FIGS. 8, 9, and 10, respectively, may be configured to be an input antenna structure or an output antenna structure as described in previous embodiments. Accordingly, an output antenna structure or an input antenna structure may be configured to transmit electromagnetic signals in various frequency ranges, including ranges that are below 1 GHz as well as ranges that include frequencies up to about 400 GHz, or higher.

Figure 11:
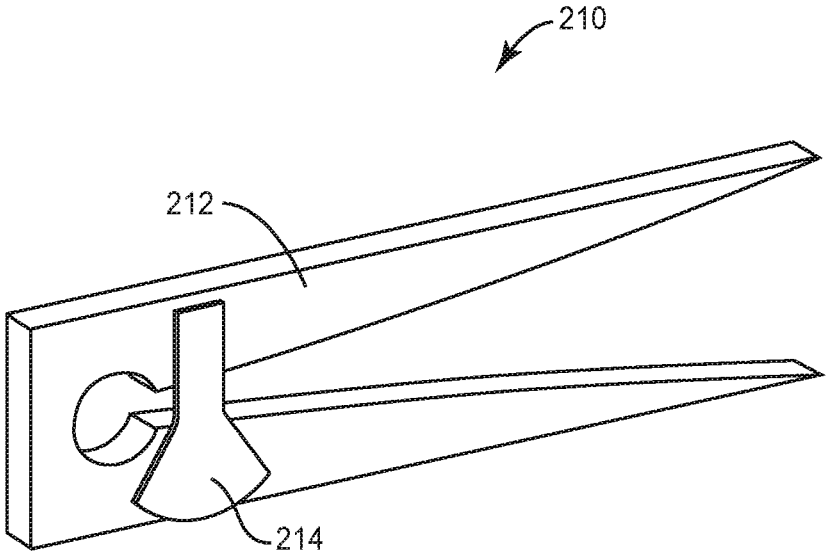
FIG. 11 is a perspective view of an antenna structure according to some embodiments.

Additional antenna designs are possible, such as a stub-launch antenna design, as shown by an antenna structure 210 of FIG. 11. The antenna structure 210 comprises a ground conductor 212 and a signal conductor 214 that are entirely separate by air. The antenna structure 210 is configured of metal thick enough so that a supporting substrate such as a printed circuit board is not required. Accordingly, the antenna structure 210 may comprise a Vivaldi antenna that is free of printed circuit board materials.

Those skilled in the art will recognize improvements and modifications to the preferred embodiments of the present disclosure. All such improvements and modifications are considered within the scope of the concepts disclosed herein and the claims that follow.

What is claimed is:

1. A spatial power-combining device comprising:

an input coaxial waveguide section;

an output coaxial waveguide section;

a center waveguide section that is between the input coaxial waveguide section and the output coaxial waveguide section, wherein the center waveguide section comprises:

an input center waveguide section comprising an input inner housing and an input outer housing, the input inner housing comprising a plurality of input signal conductors;

an output center waveguide section comprising an output inner housing and an output outer housing, the output inner housing comprising a plurality of output signal conductors; and a core section that forms an integral single component with the input inner housing and the output inner housing; and a plurality of amplifiers that are registered with the core section.

2. The spatial power-combining device of claim 1 wherein the input center waveguide section, the output center waveguide section, and the core section are formed completely of metal.

3. The spatial power-combining device of claim 1 wherein the input outer housing comprises a plurality of input ground conductors.

4. The spatial power-combining device of claim 3 wherein the plurality of input signal conductors and the plurality of input ground conductors form an input antenna assembly.

5. The spatial power-combining device of claim 4 wherein the input antenna assembly comprises a plurality of input antennas, wherein each input antenna of the plurality of input antennas comprises an input signal conductor of the plurality of input signal conductors and an input ground conductor of the plurality of input ground conductors.

6. The spatial power-combining device of claim 5 wherein each input antenna of the plurality of input antennas is electromagnetically connected with a corresponding amplifier of the plurality of amplifiers.

7. The spatial power-combining device of claim 1 wherein the output outer housing comprises a plurality of output ground conductors.

8. The spatial power-combining device of claim 7 wherein the plurality of output signal conductors and the plurality of output ground conductors form an output antenna assembly.

9. The spatial power-combining device of claim 8 wherein the output antenna assembly comprises a plurality of output antennas, wherein each output antenna of the plurality of output antennas comprises an output signal conductor of the plurality of output signal conductors and an output ground conductor of the plurality of output ground conductors.

10. The spatial power-combining device of claim 9 wherein each output antenna of the plurality of output antennas is electromagnetically connected with a corresponding amplifier of the plurality of amplifiers.

11. The spatial power-combining device of claim 1 wherein the plurality of amplifiers comprises a plurality of Monolithic Microwave Integrated Circuit (MMIC) amplifiers.

12. A spatial power-combining device comprising:

an input coaxial waveguide section;

an output coaxial waveguide section;

a center waveguide section that is between the input coaxial waveguide section and the output coaxial waveguide section, wherein the center waveguide section comprises:

an input center waveguide section comprising an input inner housing and an input outer housing;

an output center waveguide section comprising an output inner housing and an output outer housing; and a core section that is attached to the input inner housing and the output inner housing; and a plurality of amplifiers that are registered with the core section.

13. The spatial power-combining device of claim 12 wherein the input center waveguide section, the output center waveguide section, and the core section are formed completely of metal.

14. The spatial power-combining device of claim 12 wherein the input inner housing comprises a plurality of input signal conductors and the input outer housing comprises a plurality of input ground conductors.

15. The spatial power-combining device of claim 14 wherein the plurality of input signal conductors and the plurality of input ground conductors form an input antenna assembly.

16. The spatial power-combining device of claim 15 wherein the input antenna assembly comprises a plurality of input antennas, wherein each input antenna of the plurality of input antennas comprises an input signal conductor of the plurality of input signal conductors and an input ground conductor of the plurality of input ground conductors.

17. The spatial power-combining device of claim 16 wherein each input antenna of the plurality of input antennas is electromagnetically connected with a corresponding amplifier of the plurality of amplifiers.

18. The spatial power-combining device of claim 12 wherein the output inner housing comprises a plurality of output signal conductors and the output outer housing comprises a plurality of output ground conductors.

19. The spatial power-combining device of claim 18 wherein the plurality of output signal conductors and the plurality of output ground conductors form an output antenna assembly.

20. The spatial power-combining device of claim 19 wherein the output antenna assembly comprises a plurality of output antennas, wherein each output antenna of the plurality of output antennas comprises an output signal conductor of the plurality of output signal conductors and an output ground conductor of the plurality of output ground conductors.

21. The spatial power-combining device of claim 20 wherein each output antenna of the plurality of output antennas is electromagnetically connected with a corresponding amplifier of the plurality of amplifiers.

22. The spatial power-combining device of claim 12 wherein the plurality of amplifiers comprises a plurality of Monolithic Microwave Integrated Circuit (MMIC) amplifiers.

23. The spatial power-combining device of claim 12 wherein the core section is attached to the input inner housing and the output inner housing by at least one of a screw or other threaded connection, a bolt, a pin, a press-fit connection, or an adhesive.

24. A spatial power-combining device structure comprising:

an input antenna assembly comprising a plurality of input signal conductors and a plurality of input ground conductors;

an output antenna assembly comprising a plurality of output signal conductors and a plurality of output ground conductors; and a core section between the input antenna assembly and the output antenna assembly, wherein the core section forms an integral single component with the plurality of input signal conductors and the plurality of output signal conductors.

25. The spatial power-combining device structure of claim 24 wherein the input antenna assembly, the output antenna assembly, and the core section are formed completely of metal.

* * * * *